United States Patent [19]

Kramer

[11] 4,364,420

[45] Dec. 21, 1982

[54] FOLDABLE NOSE GUIDE DEVICE FOR A HEDDLE FRAME

[75] Inventor: Charles F. Kramer, Greenville, S.C.

[73] Assignee: Steel Heddle Manufacturing Company, Greenville, S.C.

[21] Appl. No.: 246,376

[22] Filed: Mar. 23, 1981

[51] Int. Cl.[3] ..... D03C 9/06

[52] U.S. Cl. ..... 139/91; 16/325; 16/319

[58] Field of Search ..... 139/91, 92; 16/221, 16/223, 339, 342, 386, 319, 325

[56] References Cited

U.S. PATENT DOCUMENTS

| | | | |
|---|---|---|---|
| 588,294 | 8/1897 | Riecker | 16/342 |
| 3,874,419 | 4/1975 | Wagner | 139/91 |
| 4,091,844 | 5/1978 | Underwood | 139/91 |

*Primary Examiner*—Henry Jaudon

*Attorney, Agent, or Firm*—Dority & Flint

[57] ABSTRACT

A guide device A is disclosed for attachment to a heddle frame to space and align adjacent heddle frames on a weaving loom during shedding which includes a pair of guide legs 26 and 28 which pivot from a guide position to a folded position for accommodating placement of the heddle frame on an automatic warp threading machine.

8 Claims, 6 Drawing Figures

FOLDABLE NOSE GUIDE DEVICE FOR A HEDDLE FRAME

BACKGROUND OF THE INVENTION

The invention relates to a weaving loom harness, and, more particularly to a nose guide device which is attached to a frame slat of a heddle frame for maintaining spacing between adjacent parallel heddle frames during shedding operations wherein the heddle frames reciprocate in alternate up and down movements. More recently, it has become desirable to place the heddle frames on automatic warp threading machines where the heddles are threaded with warps. However, the problem arises that certain types of automatic warp threading machines have insufficient spacing to accommodate placement of the heddle frames with the guide device attached to the heddle frame. Thus, it becomes necessary to remove the guide device from the heddle frame before placing the heddle frame on the automatic warp threading machine and re-attach the guide device to the heddle frame before operating the heddle frame on the weaving loom.

To expedite removal of the guide device from the heddle frame, guiding attachments have been proposed, such as that shown in U.S. Pat. Nos. 3,874,419, which may be quickly detached and re-attached in a rigid connection. This is in contrast to the typical nose guide devices which are often secured by screws, and other conventional fastening means which require much time and labor in the removal and attachment of the guide device. However, in approaching the problem in this manner, the problem arises that when the guide device often becomes misplaced or damaged when removed and may not be re-attached to the heddle frame before the weaving operation begins.

Accordingly, it is an important object of the present invention to provide a nose guide device for a heddle frame which accommodates placement of the heddle frame on an automatic warp threading machine without the need of removing the guide device.

Another important object of the present invention is to provide a nose guide device which can be folded to accommodate placement of the heddle frame on an automatic warp threading machine and may be unfolded to a guide position when operating the frame on a weaving loom.

Still another important object of the present invention is to provide a nose guide device for a heddle frame having a pair of guide legs which may be pivoted between an operational guide position and a folded position without sacrificing the structural integrity of the guide device and its function in maintaining spacing between adjacent parallel heddle frames.

SUMMARY OF THE INVENTION

According to the present invention, the above objectives are accomplished by a nose guide device which may be attached to the slats of a heddle frame and need not be removed when the heddle frame is placed on an automatic warp threading machine wherein the guide device comprises a pair of side plates which include means for attachment to the heddle frame slat and a pair of guide legs pivotably carried by the plate which terminate in free ends. The guide legs are pivotable from a downwardly depending guide position to a lateral, folded position. When in the folded position, the guide legs occupy less vertical space relative to the horizontal frame slat than when in the guide position. With the guide legs folded, the heddle frame assembly may be placed on an automatic warp threading machine. The pivotable legs are held in the guide and folded position by positive holding means. The entire guide device is preferably made from a thermoplastic material and is lightweight and sturdy and the connections and assemblies are structurally rigid when in use.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
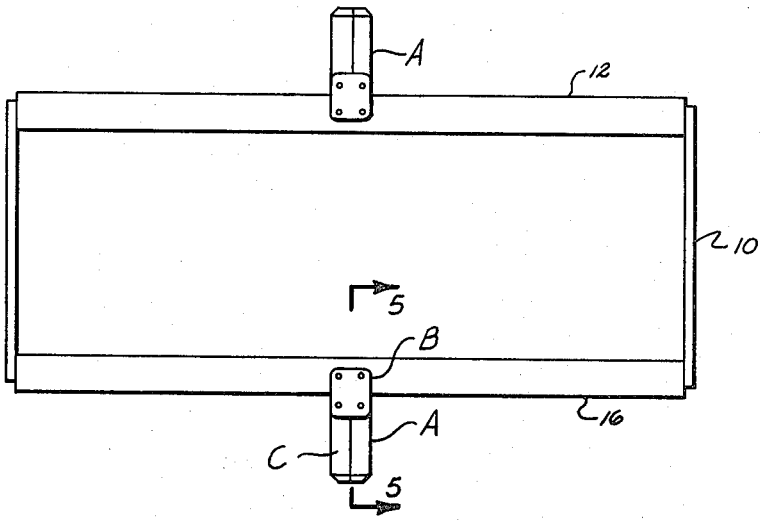
FIG. 1 is a front elevation illustrating a heddle frame having a guide device attached thereto in accordance with the present invention.
Figure 2:
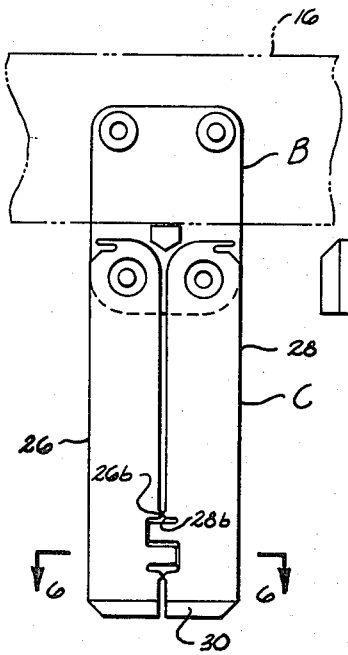
FIG. 2 is a front elevation illustrating a guide device constructed in accordance with the present invention with the front plate removed illustrating the pivotable guide legs in a guide position.

The invention relates generally to a weaving loom harness wherein warp yarns are held in individual heddles which are supported on a heddle frame, and, in particular, to a unique nose guide attachment. Since weaving looms and heddle frames are well known in the art, only that portion which is necessary to an understanding of the invention is illustrated. Accordingly, only the heddle frame itself is illustrated in the drawing with the individual heddles and supporting bars omitted.

Referring now to the drawings, a nose guide device A is illustrated for maintaining adjacent heddle frames such as 10 spaced apart during shedding operations wherein the heddle frames reciprocate vertically in alternate up and down motions. Each heddle frame 10 includes a top heddle frame slat 12 and a bottom heddle frame slat 16.

The guide device includes side plate means B which includes attachments means for fixing the plate means to the heddle frame slats 12 and 16. A pair of guide legs C are pivotably carried by the plate means B terminating in free ends. The guide legs are pivotable from a generally fixed guide position in which the legs depend downwardly to a generally fixed folded position in which the guide legs are pivoted upwardly in a lateral direction from the guide position. Means are provided for fixing and maintaining the legs in either the guide or folded position. The free ends of the guide legs have a lesser relative vertical distance from the frame slat in the folded position than in the guide position whereby the heddle frame may be placed in the available space on an automatic warp threading machine without the need for removing the guide device from the heddle frame. With the legs 26, 28 folded and essentially parallel to the frame slat, the overall height is sufficiently reduced to permit clear passage between the worm stand of the warp threading machine. This reduction in guide height during drawing-in is only required on the bottom slat. However, it is conceivable that a resultant reduction in size of the shipping container and/or storage space could make its application to the top slat also desirable.

As illustrated, the plate means B includes a pair of front and back side plates 18 and 20 and the attachment means for attaching the plate means to the heddle frame slat 16 includes a pair of spaced openings 16*a* formed in the heddle frame slat and a snap connection between the front and back side plates which is received in the opening. For simplicity and economy, it is preferred that the front and back side plates 18 and 20 be identical and include annular fastening openings 22 and cooperating snap projections 24 which, when fitted together, form a secure snap connection. When the plates are made identical and fitted together, snap projections 24 and the snap openings 22 correspond and align with one another for making four rigid snap connections.

As illustrated, the pivotable guide leg means is provided by a pair C of guide legs which include a first pivotable guide leg 26 and a second pivotable guide leg 28 which are carried about hubs 22*a* and 24*a* of the snap connections. The guide legs are tapered at 30 so as to guide smoothly between adjacent heddle frames.

Figure 6:
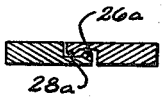
FIG. 6 is a sectional view taken along line 6—6 of FIG. 2.

First means for locking the legs together in their guide position includes an interlocking arrangement wherein each leg has a protuberant portion 26*a* and 28*a* which snap past each other and interlock as shown in FIG. 6. Spaced protuberances 26*b* and 28*b* together with the snap protuberances 26*a* and 28*a* form a rigid interlocking connection for the legs in which together the legs afford a rigid unitary nose guide for spacing heddle frames during shedding.

Figure 3:
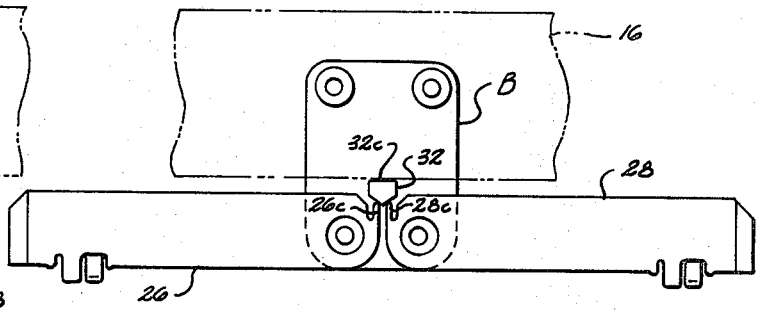
FIG. 3 is a front elevational view of a guide device constructed in accordance with the present invention with the front plate thereof removed illustrating the guide legs in a folded position.
Figure 4:
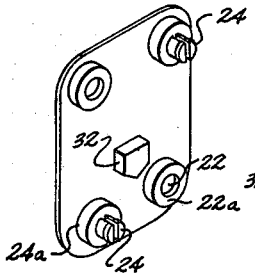
FIG. 4 is a perspective view illustrating an attachment plate for a foldable guide device constructed in accordance with the present invention.
Figure 3A:
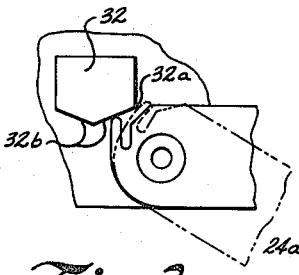
FIG. 3*a* is a schematic view illustrating the camming and resilient finger action which maintains the guide legs in their folded configuration in accordance with the present invention.
Figure 5:
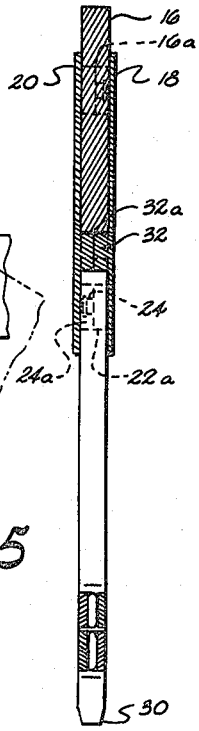
FIG. 5 is a sectional view taken along line 5—5 of FIG. 1.

Second means for maintaining the guide legs in their folded position, as shown in FIG. 3, is illustrated as including an integral cam portion 32 formed on plate means B and resilient finger portions 28*c* and 26*c* formed on respective guide legs. The resilient fingers must flex to get past the corner 32*a* of the cam when the guide legs are pivoted in either a clockwise or counterclockwise direction therepast. The guide legs are normally held in their folded position as shown in FIG. 3 by the tip of the resilient fingers being in engagement with the inclined cam surface 32*b*. To be moved into or out of the guide position, the resilient finger must be bent inwardly to get past the corner 32*a* (FIG. 3*a*). Such provides a simplified highly desirable means for fixing the legs in their folded position and since the guide plates are identical, the cam 32 forms one-half of the total cam surface provided when the side plates are fitted together.

With the upper snap connections made through openings 16*a* in the slat, the bottom of the slat engages the top 32*a* of cam 32.

While a preferred embodiment of the invention has been described using specific terms, such description is for illustrative purposes only, and it is to be understood that changes and variations may be made without departing from the spirit or scope of the following claims.

What is claimed is:

1. A guide device for spacing and aligning adjacent heddle frames of a weaving loom during shedding wherein said heddle frames are of the type including top and bottom frame slats, said guide device comprising:

side plate means including attachment means for affixing said plate means to a heddle frame slat;

a pair of guide legs pivotally carried by said plate means terminating in free ends;

said guide legs being pivotable from a generally fixed guide position in which the legs depend downwardly to a generally fixed folded position;

first mean for fixing said legs in said guide position;

second means for maintaining said legs in said folded position; and said free ends of said guide legs having a lesser relative vertical distance from said frame slat in said folded position than when in said guide position;

whereby said heddle frame may be placed on an automatic warp threading machine by manually positioning said guide legs in said folded position and thereafter said guide legs may be manually positioned in said guide position for utilization on said weaving loom machine without the need for removing said guide device from the slat when transferring said heddle frame between said machines.

2. The device of claim 1 wherein said first means for fixing said legs in said guide position include cooperating interlocking means carried by each said depending leg which locks said legs rigidly together in said guide position.

3. The device of claim 1 wherein said guide legs are generally parallel to said frame slat when in said folded position.

4. The device of claim 1 including resilient finger means carried by said guide legs and cam means carried by said plate means engaging said resilient finger means for holding said guide legs in said folded position.

5. The device of claim 1 wherein said second means for maintaining said legs in said folded positioning includes biasing means which said legs must overcome to pivot from said folded position to said guide position.

6. The device of claim 1 wherein said plate means includes a pair of spaced plates between which said guide legs are pivotably carried, said plates being identical wherein each said plate includes a plurality of openings and a plurality of projections which fit into said openings for fastening said plates together, and at least one of said plates includes an integral cam against which opposing ends of said fingers are biased to provide said second means for maintaining said legs in said folded position.

7. The device of claim 1 wherein said attachment means includes an integral cam carried by said plate means against which ends of said guide fingers are biased to maintain said guide legs in said lateral position, said frame slat resting on one position thereof against said cam and being secured to another portion thereof to said plate means.

8. A guide device for spacing and aligning adjacent heddle frames of a weaving loom during shedding wherein said heddle frames are of the type including top and bottom frame slats, said guide device comprising:

said plate means including attachment means for affixing said plate means to a heddle frame slat;

guide leg means pivotally carried by said plate means;

said guide leg means foldable from a guide position in which said guide leg means depends downwardly to a folded position in which said guide leg means is pivoted generally in a vertical plane from said guide position;

first means for fixing said guide leg means in said guide position;

second means for maintaining said guide leg means in said folded position; and said guide leg means occupying less vertical space relative to said frame slat when in said folded position than when in said guide position;

whereby said heddle frame may be placed on an automatic warp threading machine by manually positioning said guide leg means in said folded position and thereafter said guide leg means may be positioned in said guide position for utilization on said weaving loom.

* * * * *